US006401970B1

(12) United States Patent
Harris et al.

(10) Patent No.: US 6,401,970 B1
(45) Date of Patent: Jun. 11, 2002

(54) SPIN-TOP CANDY DISPENSER

(75) Inventors: Jason Harris, San Rafael, CA (US); Charles Hartlaub, Glendale Heights, IL (US)

(73) Assignee: Oddzon, Inc., Pawtucket, RI (US)

( * ) Notice: Subject to any disclaimer, the term of this patent is extended or adjusted under 35 U.S.C. 154(b) by 9 days.

(21) Appl. No.: 09/690,518

(22) Filed: Oct. 17, 2000

(51) Int. Cl.[7] ..... A24F 15/04
(52) U.S. Cl. ..... 221/24; 446/246
(58) Field of Search ..... 221/24, 208, 277; 426/132, 104; 446/46, 236, 246

(56) References Cited

U.S. PATENT DOCUMENTS 5,261,851 A * 11/1993 Siebert, Jr. ..... 446/236
5,385,267 A 1/1995 Diamond et al. ..... 221/248
5,651,475 A 7/1997 Fenton ..... 221/24
5,676,988 A * 10/1997 Coleman et al. ..... 426/134
5,779,095 A 7/1998 Diamond ..... 221/263

* cited by examiner

*Primary Examiner*—Kenneth W. Noland
(74) *Attorney, Agent, or Firm*—Marshall, Gerstein & Borun

(57) ABSTRACT

A candy dispenser may be provided with a housing having a candy reservoir formed therein in which a plurality of pieces of candy may be disposed, a spin top having a downwardly extending member that is centrally located on the spin top to facilitate spinning of the spin top while the downwardly extending member supports the spin top, a candy dispensing mechanism including a candy dispensing opening that allows a piece of candy to be dispensed from the candy reservoir, and an actuator associated with the spin top and the candy dispensing mechanism. The actuator may be movable to a first position and to a second position, with movement of the actuator to the first position causing the spin top to be launched from the housing so that the spin top may land on a surface and spin on its downwardly extending member, and with movement of the actuator to the second position causing one of the pieces of candy to be dispensed through the dispensing opening.

24 Claims, 4 Drawing Sheets

FIG. 4
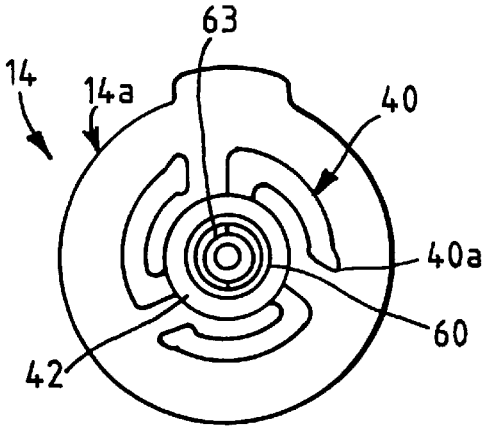
FIG. 5
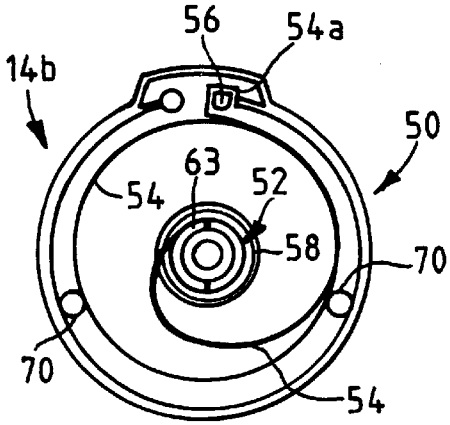
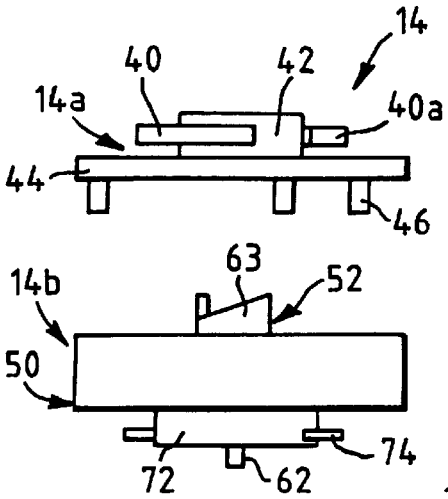
FIG. 6
FIG. 7
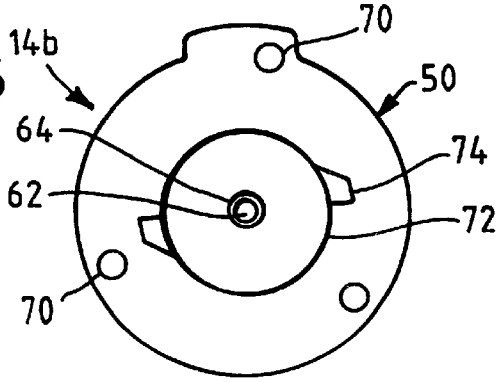
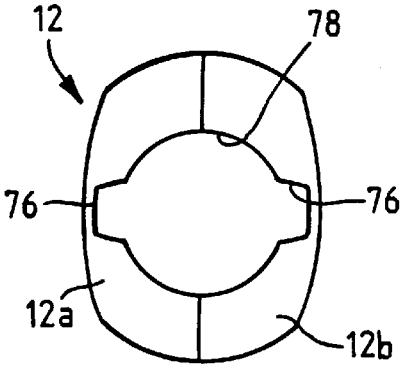
FIG. 9
FIG. 10
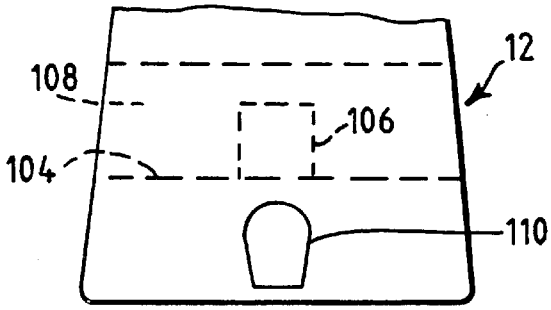

SPIN-TOP CANDY DISPENSER

BACKGROUND OF THE INVENTION

The present invention relates to a candy dispenser for dispensing pieces of candy and which has a spin top that can be launched from the candy dispenser.

Various types of candy dispensers have been previously described. For example, U.S. Pat. No. 5,651,475 to Fenton discloses a candy dispenser with a housing shaped like an animal. The housing has a hollow inner cavity in which a plurality of pieces of candy may be stored and an exit hole through which a piece of candy may be dispensed. A piece of candy may be dispensed through the exit hole by moving the position of the head of the animal, which is pivotally connected to the housing. The head of the animal is connected to a sliding gate, and pivotal movement of the head causes the sliding gate to move to either cover or uncover the exit hole.

U.S. Pat. No. 5,676,988 to Coleman, et al. discloses a lollipop holder which has an upper portion that is designed to hold a lollipop and a lower portion which is designed to launch a spinning object or flying disk. The flying disk is attachable to the lollipop holder and is operatively coupled to a spinner shaft and a coil spring. While attached to the lollipop holder, the flying disk may be rotated so that the coil spring winds up, and then the flying disk may be launched via a launch button.

SUMMARY OF THE INVENTION

In one aspect, the invention is directed to a candy dispenser that may be provided with a housing having a candy reservoir formed therein in which a plurality of pieces of candy may be disposed, a spin top having a downwardly extending member that is centrally located on the spin top to facilitate spinning of the spin top while the downwardly extending member supports the spin top, a candy dispensing mechanism including a candy dispensing opening that allows a piece of candy to be dispensed from the candy reservoir, and an actuator associated with the spin top and the candy dispensing mechanism. The actuator may be movable to a first position and to a second position, with movement of the actuator to the first position causing the spin top to be launched from the housing so that the spin top may land on a surface and spin on its downwardly extending member, and with movement of the actuator to the second position causing one of the pieces of candy to be dispensed through the dispensing opening.

The spin top may have an upper portion with an animated figure disposed thereon, and the spin top may be provided with a lower portion with at least one latching member associated therewith. The candy dispenser may additionally include a latch having a flexible arm with an end that makes contact with the latching member to maintain the spin top in a ready state.

The candy dispenser may also include a spring associated with the actuator that maintains the actuator in a neutral position between the first and second positions, and the spin top may have a plastic material with a mass-per-unit-volume and a weight disposed within the plastic material, with the weight having a mass-per-unit-volume greater than that of the plastic material.

In another aspect, the invention is directed to a candy dispenser that may be provided with a housing having a candy reservoir formed therein in which a plurality of pieces of candy may be disposed, a spin top having a downwardly extending member that is centrally located on the spin top to facilitate spinning of the spin top while the downwardly extending member supports the spin top, a candy dispensing mechanism including a candy dispensing opening that allows a piece of candy to be dispensed from the candy reservoir through the candy dispensing opening in the housing, a launching mechanism that causes the spin top to be launched from the housing, and an actuator associated with the launching mechanism that is movable to a launching position to cause the spin top to be launched from the housing so that the spin top may land on a surface and spin on its downwardly extending member.

The features and advantages of the present invention will be apparent to those of ordinary skill in the art in view of the detailed description of the preferred embodiment, which is made with reference to the drawings, a brief description of which is provided below.

BRIEF DESCRIPTION OF THE DRAWINGS

FIG. 4 is a top view of a cap of the candy dispenser;

FIG. 5 is a top view of a bottom section of the cap of FIG. 4;

FIG. 6 is an exploded side view of the cap of FIG. 5;

FIG. 7 is a bottom view of the lower cap section of the candy dispenser;

FIG. 9 illustrates the top of the candy dispenser housing;

FIG. 10 is a front view of a portion of the candy dispenser housing;

DETAILED DESCRIPTION OF VARIOUS EMBODIMENTS

Figure 1:
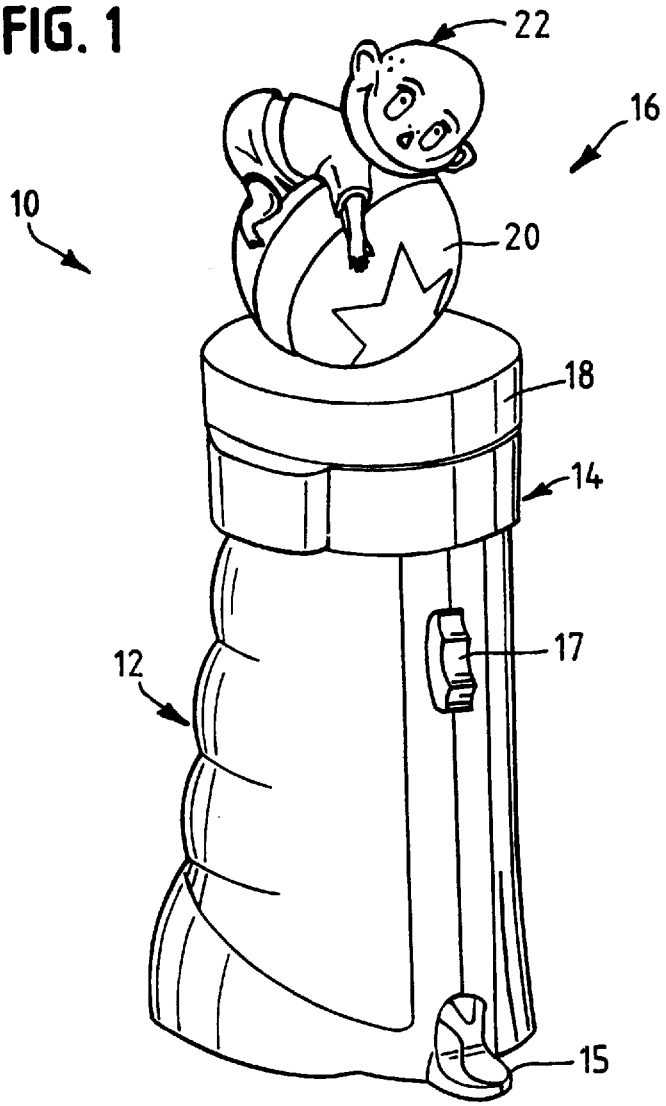
FIG. 1 is a perspective view of one embodiment of a candy dispenser in accordance with the invention.

FIG. 1 is a perspective view of one possible embodiment of a candy dispenser 10 in accordance with the invention. Referring to FIG. 1, the candy dispenser 10 may be provided with a housing 12, a cover member or cap 14 that may be removably attachable to the housing 12, and a spin top 16 that may be removably attachable above the cap 14. The candy dispenser 10 may be provided with a dispensing tray 15 and an actuator button 17 that may be moved to a first position to launch the spin top 16 from the top of the dispenser 10 or to a second position to dispense one or more pieces of candy from the interior of the candy dispenser 10 to the dispensing tray 15.

The spin top 16 may be provided with a lower cylindrical portion 18, a spherical portion 20 attached to the lower cylindrical portion 18 and centrally located over the lower cylindrical portion 18, and an animated FIG. 22 disposed on the top of the spherical portion 20. The spherical portion 20 may be colored or decorated so that it appears to be a game ball, and the animated figure may be a human or humanoid figure, such as a "Rugrats" character.

Figure 2:
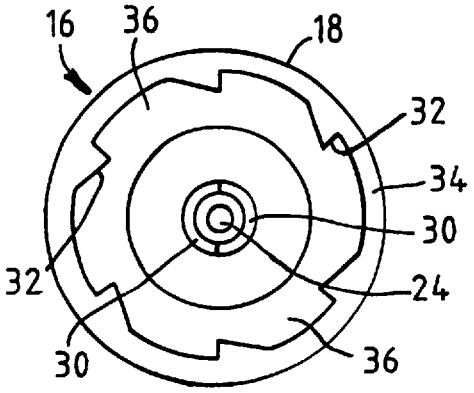
FIG. 2 is a bottom view of a spin top that may be attached on top of the candy dispenser.
Figure 3:
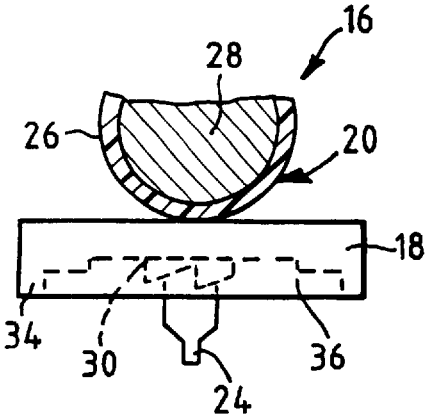
FIG. 3 is a side view of a portion of the spin top of FIG. 2 with portions shown in cross-section.

Referring to FIGS. 2 and 3, the spin top 16 may be provided with a downwardly extending member or spinner tip 24 which may support the spin top 16 when it is spinning on a surface. As shown in FIG. 3, the spherical portion 20 of the spin top 16 may be provided with an outer plastic layer 26 and an inner portion or member 28. The density or mass-per-unit-volume of the material of the inner member 28 may be selected to be greater than that of the outer plastic layer 26 to facilitate spinning of the top or increase the time which the spin top 16 spins on a surface. For example, the inner portion 28 of the spherical portion 20 may be composed of metal. An interior portion of the cylindrical portion 18 of the spin top 16 may also be provided with a more dense insert, such as a metal ring, to enhance the spinning of the spin top 16.

FIG. 2 illustrates the bottom of the spin top 16. Referring to FIGS. 2 and 3, the bottom of the spin top 16 may be provided with one or more arcuate members 30 which are disposed around the spinner tip 24. As shown in FIG. 3, the arcuate members 30 may be designed so that, when viewed from the side, they appear sawtooth-shaped. The bottom side of the spin top 16 may be provided with a plurality of latching members 32, which may be triangularly shaped, for example, that extend inwardly from an outer peripheral area 34 of the underside of the spin top 16. The latching members 32 may be provided so that they are flush or substantially flush with the lowermost surface of the cylindrical portion 18 of the spin top 16, so that a generally annular, inwardly recessed area 36 is formed in the underside of the spin top 16.

As shown in FIG. 6, the cap 14 may be provided with a two-piece construction composed of an upper cap assembly or member 14*a* and a lower cap assembly 14*b*. FIG. 4 is a top view of the upper side of the cap 14. Referring to FIGS. 4 and 6, the upper side of the cap 14 may be provided with a plurality of latching members 40, which may be provided as latching arms. Each of the latching arms 40 may be provided with an inner end that is integrally formed with or otherwise fixed to a cylindrically shaped member 42 and an outer end or tip 40*a* that is spaced from the cylindrically shaped member 42.

Referring to FIG. 6, each latching arm 40 may be disposed above a cylindrically shaped plate 44 that forms the base of the upper cap member 14*a*. A plurality of cylindrical connecting members 46 may be integrally formed with or otherwise attached to the base plate 44 to facilitate the attachment of the upper cap member 14*a* to the lower cap member 14*b*, in any manner, such as by a plurality of screws (not shown). The base plate 44 may have a plurality of holes (not shown) formed therein that are shaped substantially the same as the latching arms 40, with the holes being disposed directly below and substantially aligned with the latching arms 40.

FIG. 5 is a top view of the lower cap assembly 14*b*, and FIG. 7 is a bottom view of the lower cap assembly 14*b*. Referring to FIGS. 5–7, the lower cap assembly 14*b* may be provided with three components: a lower cap member 50, a rotatable member 52, and a helical spring 54 that operatively interconnects the rotatable member 52 to the lower cap member 50. As shown in FIG. 5, the spring 54 may be provided with an inner end that is connected to the rotatable member 52, such as by being disposed in or through a slot (not shown) in the rotatable member 52 and an outer end 54*a* that is disposed around a retaining post 56 that is integrally formed with or otherwise connected to the lower cap member 50.

The rotatable member 52 may be provided with an annular retaining portion 58 that has an outer diameter than is larger than the inner diameter of a hole or bore 60 (FIG. 4) formed in the upper cap member 14*a*. In that case, when the upper cap member 14*a* is fixed to the lower cap assembly 14*b*, upward movement of the rotatable member 52 is limited. Upward movement of the rotatable member 52 may be caused by upward pressure exerted on a launching pin 62 that may be integrally formed on the bottom of the rotatable member 52. The upper portion of the rotatable member 52 may be provided with one or more arcuate members 63, which may have sawtooth-shaped portions, that are designed to mate with the arcuate members 30 formed in the underside of the spin top 16.

Downward movement of the rotatable member 52 may be limited by an annular retaining portion (not shown) integrally formed with the rotatable member 52, with the diameter of such annular retaining portion being larger than the diameter of a hole 64 formed in the base member 50 through which the launching pin 62 may pass.

The annular retaining portions described above may be vertically positioned on the rotatable member 52 so that the rotatable member 52 is rotatably trapped within the cap 14, while retaining the ability to be vertically moved, relative to the cap 14, to some degree, such as by one-eighth of an inch or one-fourth of an inch, for example.

Referring to FIGS. 6 and 7, the lower cap member 50 may be provided with a plurality of holes 70, through which screws (not shown) maybe threaded, to facilitate attachment of the lower cap assembly 14*b* to the upper cap member 14*a*.

The lower cap member 50 may be provided with a downwardly extending cylindrical portion 72 having one or more retaining tabs 74 integrally formed therewith or otherwise connected thereto. The tabs 74 may be positioned to coincide with the position of one or more slots 76 (FIG. 9) formed in an upper portion of the housing 12, so that when the cap 14 is positioned on top of the housing with the tabs 74 disposed in the slots 76 and when the cap 14 is subsequently turned, the cap 14 will be secured onto the top of the housing 12.

Figure 8:
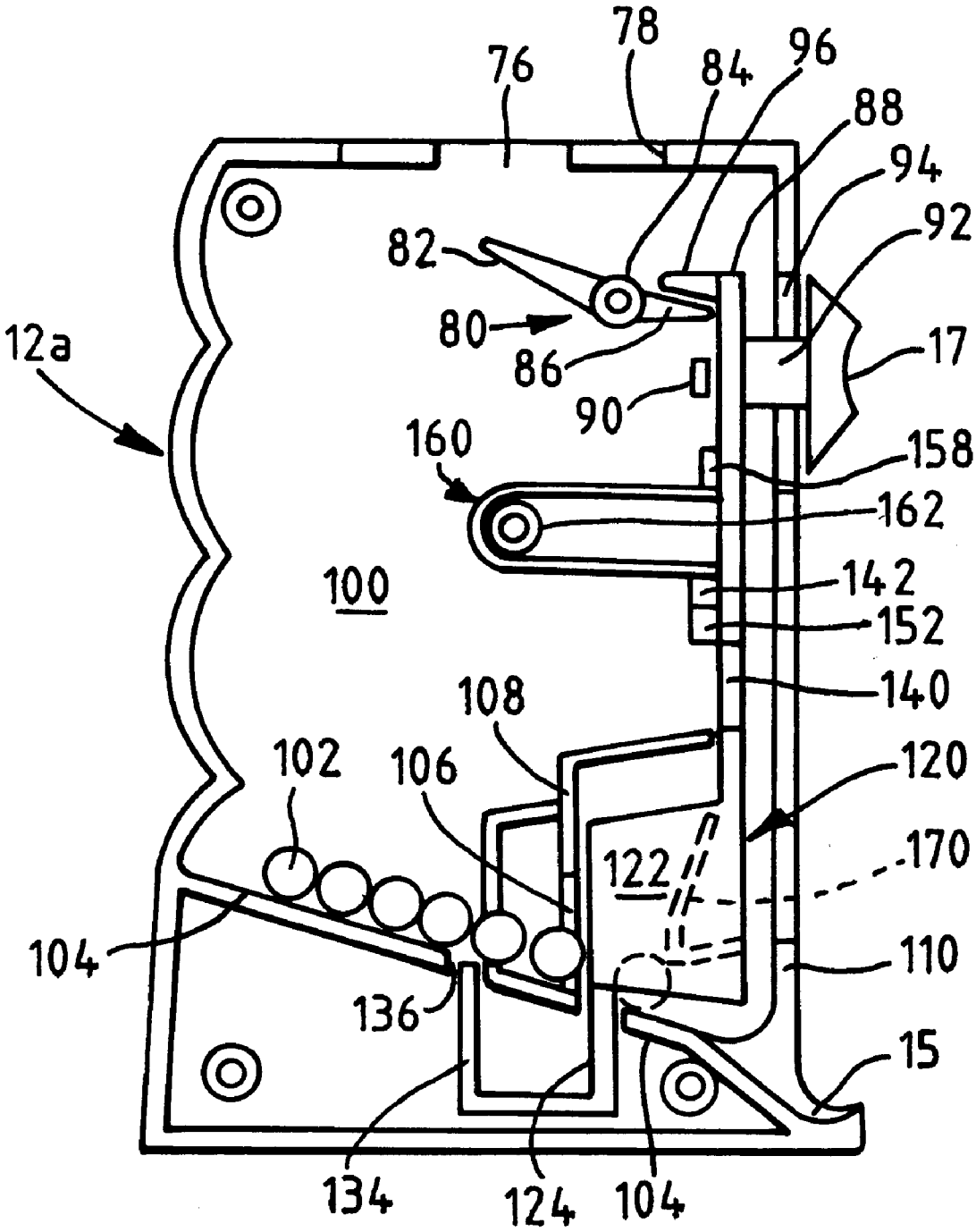
FIG. 8 is a side view of a portion of the candy dispenser shown with the cap removed.

Referring to FIG. 9, the upper portion of the housing 12 may have a candy-refill hole 78 formed therein, and the thickness of the upper walls of the upper portion of the housing 12 may be varied slightly, as shown in FIG. 8, to help retain the attachment of the cap 14 to the housing 12. Other ways of attaching the cap 14 to the housing 12 may be utilized, such as threads. As shown in FIG. 9, the housing 12 may be provided as two housing sections 12*a*, 12*b*, which may be secured together in any fashion, such as by screws, adhesive or ultrasonic welding.

FIG. 8 illustrates one of the housing sections 12*a* and a number of components of the candy dispenser 10. In FIG. 8 and in other figures, some dimensions have been exaggerated or changed to facilitate clear illustration of the components. Referring to FIG. 8, a pivotable launching member 80 may be connected to an interior portion of the housing 12. The launching member 80 may be provided with a launching arm 82 that may make physical contact with the bottom of the launching pin 62 (FIG. 6) when the cap 14 is secured to the housing 12. The launching arm 82 may be connected to a central member 84 that is pivotably connected to the housing 12, such as by being mounted between a pair of cylindrical mounting posts (not shown) that extend inwardly from the housing walls. The launching member 80 may also be provided with a trigger arm 86 connected to the central member 84.

The actuator button 17 may be integrally formed with an actuator mechanism, such as a slide member 88, that may be slidably captured between the outer housing wall and one or more guide posts 90 integrally formed with or otherwise connected to interior portions of the housing 12. The actuator button 17 may be connected to the slide member 88 via a connecting portion or member 92, which may pass through a slot 94 formed in the housing 12. An upper end of the slide member 88 may be provided with a trigger arm 96. The slide member 88 and its trigger arm 96 may be positioned so that downward movement of actuator button 17 and the slide member 88 to which it is attached causes the trigger arm 96 to force the trigger arm 86 downwardly, which in turn causes the launching arm 82 to move upwardly to force the launching pin 62 upwardly and launch the spin top 16 from the housing 12, as described in further detail below.

The interior portion of the housing 12 forms a candy reservoir 100 in which a plurality of pieces of candy 102 may be disposed. The candy pieces 102 may be, for example, spherical or generally spherical. Referring to FIGS. 8 and 10, the interior of the housing 12 may be provided with a housing portion or candy reservoir floor 104 that is shaped to direct or urge candy pieces 102 towards an internal housing opening 106, which may be formed in an internal housing wall 108, and towards a candy dispensing opening 110 formed in an exterior side wall of the housing 12. The candy dispensing opening 110 may be aligned with the dispensing tray 15 so that a candy piece 102 that passes through the interior opening 106 will land in and be held by the dispensing tray 15.

Figure 14:
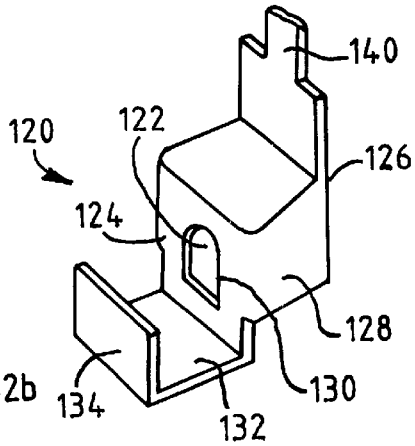
FIG. 14 is a perspective view of a portion of a candy-dispensing mechanism.
Figure 15:
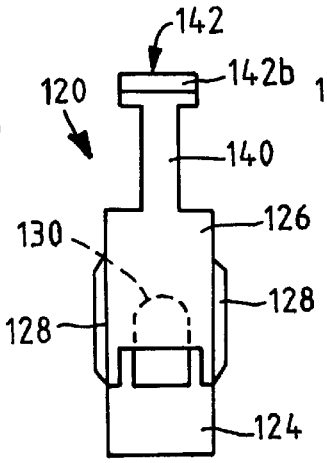
FIG. 15 is a front view of a candy dispensing shuttle.

FIG. 14 is a perspective view of a portion of a dispenser member 120, and FIG. 15 is a side view of the dispenser member 120, as viewed from the right in FIG. 8. Referring to FIGS. 8, 14 and 15, the dispenser member 120 may be provided with a dispensing chamber 122 formed by an inner side wall 124, an outer side wall 126 and a pair of side walls 128 that may be generally perpendicular to the side walls 124, 126. The inner side wall 124 may have an opening 130 formed therein that is generally aligned with the opening 106 (FIG. 10) formed in the housing wall 108.

The dispenser member 120 may be provided with a generally horizontal plate 132 integrally formed with the inner side wall 124 and a generally vertical plate 134 integrally formed with the horizontal plate 132. The vertical plate 134 may be aligned with a slot 136 formed in the reservoir floor 104 to allow upward movement of the vertical plate 134 through the slot 136.

Figure 12:
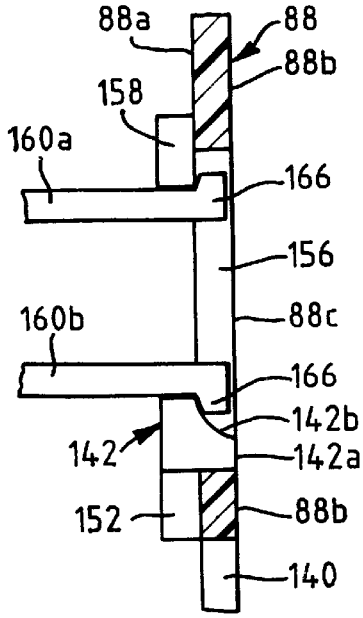
FIG. 12 is a side view of a portion of the actuator mechanism, a portion of a spring, and a portion of a candy-dispensing mechanism.
Figure 13:
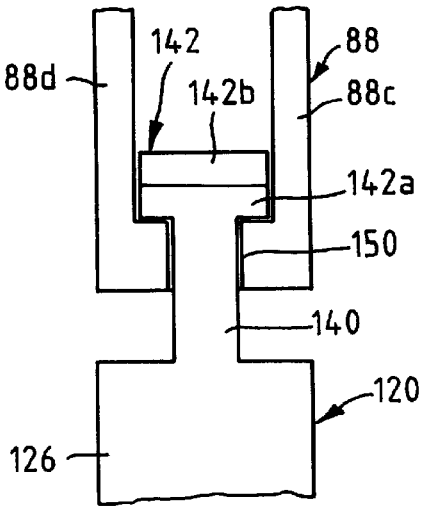
FIG. 13 is a front view of a portion of the actuator mechanism and a portion of the candy-dispensing mechanism.

The upper portion of the dispenser member 120 may be provided with a generally T-shaped portion, composed of a narrow wall section 140 and a top section 142. As shown in FIGS. 12 and 13, the top section 142 may have a flat surface 142*a* and a curved surface 142*b*. The dispenser member 120 may be operatively coupled to the slide member 88 via the T-shaped portion of the dispenser member 120. Referring to FIGS. 1113, the narrow section 140 of the dispenser member 120 may be slidably captured within a slot 150 formed in a lower retaining portion 152 of the slide member 88 so that the top portion 142 of the dispenser member 120 rests on top of the lower retaining member 152 of the slide member 88.

Figure 11:
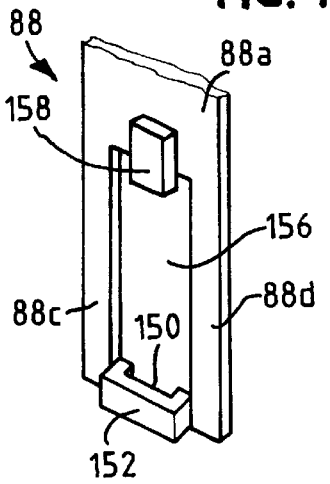
FIG. 11 is a perspective view of a portion of an actuator mechanism.

Referring to FIG. 11, the slide member 88 may be provided with an inner surface 88*a*, an outer surface 88*b* (FIG. 12), a first arm 88*c*, a second arm 88*d*, and a rectangular opening 156 formed between the two arms 88*c*, 88*d*. An upper retaining member 158 may be integrally formed with the slide member 88. The slide member 88 may be held in a neutral position, as shown in FIGS. 8 and 12, by a U-shaped spring 160 having an upper spring arm 160*a* and a lower spring arm 160*b*. The spring 160 may be anchored within the housing 12 by a mounting post 162 that extends from one of the housing walls.

The spring 160 may be composed of plastic and may be provided with a pair of retaining members 166, integrally formed at the ends of the spring arms 160*a*, 160*b*, that facilitate retention of the ends of the spring arms 160*a*, 160*b* within the aperture 156 defined by the arms 88*c*, 88*d* of the slide member 88, as shown in FIG. 12. Except as otherwise noted, all components of the candy dispenser 10 may be composed of plastic.

In operation, the candy reservoir 100 may be filled (or refilled) with candy pieces 102 by rotating and removing the cap 14 from the refill opening 78 (FIG. 9), adding candy to the candy reservoir 100 through the refill opening 78, and replacing the cap 14.

Referring to FIGS. 2, 4 and 5, the spin top 16 may be placed on top of the cap 14 so that the latch arms 40 are disposed within the recessed space 36 in the underside of the spin top 16. With the spin top 16 so placed, the spin top 16 may be rotated in order to tightly coil the helical spring 54 and to provide the helical spring 54 with potential energy. During such rotation of the spin top 16, vertically disposed portions of the arcuate members 30 formed on the underside of the spin top 16 engage and cause rotation of the arcuate members 63 integrally formed with the rotatable member 52. Consequently, the rotatable member 52 will rotate, causing the spring 54 to be wound up.

Simply letting go of the spin top 16 will not allow the spring 54 to automatically unwind because the ends 40*a* of the latching arms 40 of the cap 14 will abut the latching members 32 on the underside of the spin top 16. Consequently, the mating of the latching members 32 with the latching arms 40 will allow the spin top 16 to remain in a ready position or state from which the spin top 16 can be launched.

It may be noted that the ends 40*a* of the latching arms 40 do not prevent or significantly hamper turning the spin top 16 to coil the spring 54 since the latching arms 40 are flexible and are forced inwardly by the angled portions of the latch members 32 as the spin top 16 is rotated. It may also be noted that the tension in the wound-up spring 54 causes a relatively large amount of frictional force to be generated between the latching arms 40 of the cap 14 and the latch members 32 of the spin top 16, thus causing the spin top 16 to be held fairly strongly to the end cap 14, so that even turning the candy dispenser 10 upside down will not cause the spin top 16 to fall off of the cap 14. The tension in the spring 54 will also cause the rotatable member 52 to be held in a neutral vertical position that is below its vertical position that causes the spin top 16 to be launched.

With the spin top 16 in the ready state, it may be launched by forcing the actuator button 17 downwards from its neutral position shown in FIG. 8 to a launching position. Referring to FIG. 8, such downward movement will force the upper spring arm 160*a* downwardly and cause downward movement of the trigger arm 96, which in turn will cause downward movement of the trigger arm 86 and upward movement of the launch arm 82. The upward movement of the launch arm 82 will force the launching pin 62 (FIG. 6)

upwardly. Since the launching pin 62 is an integral part of the rotating member 52, upward movement of the launching pin 62 will cause the rotatable member 52 to move upwardly, which in turn will cause the spin top 16 to move upwardly (due to contact between the arcuate members 63 of the rotatable member 52 and the arcuate members 30 of the spin top 16). That upward movement of the spin top 16 relative to the cap 14 will cause the latching arms 40 of the cap 14 to become disengaged from the latch members 32 of the spin top 16, thus causing the spin top 16 to be launched from the cap 14.

Referring to FIG. 8, in order to dispense a candy piece 102, the actuator button 17 is moved upwardly. That upward movement will cause the lower spring arm 160*b* to flex upwardly and will cause the dispensing member 120 to move upwardly. That upward movement will allow a candy piece 102 (shown in dotted lines) in the dispensing chamber 122 to move or roll, under the influence of gravity, through the dispensing opening 110 in the housing 12 and into the dispensing tray 15.

It may be noted that, absent upward movement of the dispensing member 120, the candy piece 102 will be prevented from passing through the opening 110 since the diameter of the candy piece 102 is larger than the vertical space between a retaining member 170 disposed in the dispensing chamber 122 and integrally formed with the dispensing member 120 and the candy reservoir floor 104. Thus, absent upward movement of the dispenser member 120 (and thus the retaining member 170), the retaining member 170 keeps the candy piece 102 in the dispensing chamber 122.

It may also be noted that upward movement of the dispensing member 120 causes the internal opening 106 to be blocked by the internal wall 124 of the dispenser member 120, which prevents another candy piece 102 from entering the dispensing chamber 122 through the opening 130 (FIG. 14) formed in the dispensing member 120. Another candy piece 102 can enter the dispensing chamber 122 only after the dispensing member 120 has been returned to its normal position, as shown in FIG. 8, and in which position the opening 130 in the dispensing member 120 will be aligned with the hole 106 in the housing wall 108 to allow a candy piece 102 to pass from the candy reservoir 100 into the dispensing chamber 122.

Although the design of the dispensing mechanism described above allows only one or a relatively small number of candy pieces to be dispensed at a time, that is not considered to be an important feature of the candy dispenser 10. Furthermore, numerous changes and modifications can be made to the candy dispenser, to the candy dispensing mechanism, and to the launching mechanism without departing from the scope of the invention.

Numerous additional modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A candy dispenser, comprising:

a housing having a candy reservoir formed therein in which a plurality of pieces of candy may be disposed, said housing having an upper portion with a candy-refill opening formed therein;

a cap removably attachable to said housing to cover said candy-refill opening in said housing;

a spin top removably attachable over said cap, said spin top having a downwardly extending member that is centrally located on said spin top to facilitate spinning of said spin top while said downwardly extending member supports said spin top;

a spring associated with said spin top, said spring being operatively coupled relative to said spin top so that rotation of said spin top when said spin top is attached over said cap causes potential energy to be stored in said spring;

a latch associated with said spin top, said latch being operatively coupled to said spin top to maintain said spin top in a ready state in which said spring stores potential energy;

a candy dispensing mechanism including a candy dispensing opening that allows a piece of candy to be dispensed from said candy reservoir; and an actuator associated with said spin top and said candy dispensing mechanism, said actuator being movable to a first position and movable to a second position, movement of said actuator to said first position causing said spin top to be launched from said cap so that said spin top may land on a surface and spin on said downwardly extending member, and movement of said actuator to said second position causing one of said pieces of candy to be dispensed through said dispensing opening.

2. A candy dispenser as defined in claim 1 wherein said cap has a hollow interior portion and wherein said spring is disposed in said cap.

3. A candy dispenser as defined in claim 1 wherein said spring comprises a helically coiled spring.

4. A candy dispenser as defined in claim 1 wherein said spin top has an upper portion with an animated figure disposed thereon.

5. A candy dispenser as defined in claim 1 wherein said latch is fixed to an upper portion of said cap.

6. A candy dispenser as defined in claim 1 wherein said spin top has a lower portion with at least one latching member associated therewith and wherein said latch comprises a flexible arm having an end that makes contact with said latching member to maintain said spin top in said ready state.

7. A candy dispenser as defined in claim 1 additionally comprising a launching mechanism associated with said cap that causes said spin top to be launched from said cap when said actuator is moved to said first position.

8. A candy dispenser as defined in claim 1 additionally comprising a spring associated with said actuator that maintains said actuator in a neutral position between said first and second positions.

9. A candy dispenser as defined in claim 1 wherein said spin top comprises a plastic material having a mass-per-unit-volume and wherein a weight is disposed within said plastic material, said weight having a mass-per-unit-volume greater than that of said plastic material.

10. A candy dispenser, comprising:

a housing having a candy reservoir formed therein in which a plurality of pieces of candy may be disposed;

a cover member removably attachable to said housing;

a spin top having a downwardly extending member that is centrally located on said spin top to facilitate spinning of said spin top while said downwardly extending member supports said spin top;

a spring associated with said spin top, said spring being operatively coupled relative to said spin top so that rotation of said spin top causes potential energy to be stored in said spring;

a latch associated with said spin top, said latch being operatively coupled to said spin top to maintain said spin top in a ready state in which said spring stores potential energy;

a candy dispensing mechanism including a candy dispensing opening that allows a piece of candy to be dispensed from said candy reservoir; and an actuator associated with said spin top and said candy dispensing mechanism, said actuator being movable to a first position and movable to a second position, movement of said actuator to said first position causing said spin top to be launched from said housing so that said spin top may land on a surface and spin on said downwardly extending member, and movement of said actuator to said second position causing one of said pieces of candy to be dispensed through said dispensing opening.

11. A candy dispenser as defined in claim 10 wherein said spin top has an upper portion with an animated figure disposed thereon.

12. A candy dispenser as defined in claim 10 wherein said spin top has a lower portion with at least one latching member associated therewith and wherein said latch comprises a flexible arm having an end that makes contact with said latching member to maintain said spin top in said ready state.

13. A candy dispenser as defined in claim 10 additionally comprising a launching mechanism that causes said spin top to be launched when said actuator is moved to said first position.

14. A candy dispenser as defined in claim 10 additionally comprising a spring associated with said actuator that maintains said actuator in a neutral position between said first and second positions.

15. A candy dispenser as defined in claim 10 wherein said spin top comprises a plastic material having a mass-per-unit-volume and wherein a weight is disposed within said plastic material, said weight having a mass-per-unit-volume greater than that of said plastic material.

16. A candy dispenser, comprising:

a housing having a candy reservoir formed therein in which a plurality of pieces of candy may be disposed;

a spin top having a downwardly extending member that is centrally located on said spin top to facilitate spinning of said spin top while said downwardly extending member supports said spin top;

a candy dispensing mechanism including a candy dispensing opening that allows a piece of candy to be dispensed from said candy reservoir through said candy dispensing opening;

a launching mechanism associated with said spin top that causes said spin top to be launched from said housing; and an actuator associated with said launching mechanism, said actuator being movable to a launching position to cause said spin top to be launched from said housing so that said spin top may land on a surface and spin on said downwardly extending member.

17. A candy dispenser as defined in claim 16 wherein said spin top has an upper portion with an animated figure disposed thereon.

18. A candy dispenser as defined in claim 16 wherein said spin top has a lower portion with at least one latching member associated therewith and wherein said candy dispenser additionally comprises a latch having a flexible arm with an end that makes contact with said latching member to maintain said spin top in a ready state.

19. A candy dispenser as defined in claim 16 wherein said spin top comprises a plastic material having a mass-per-unit-volume and wherein a weight is disposed within said plastic material, said weight having a mass-per-unit-volume greater than that of said plastic material.

20. A candy dispenser, comprising:

a housing having a candy reservoir formed therein in which a plurality of pieces of candy may be disposed;

a spin top having a downwardly extending member that is centrally located on said spin top to facilitate spinning of said spin top while said downwardly extending member supports said spin top;

a candy dispensing mechanism including a candy dispensing opening that allows a piece of candy to be dispensed from said candy reservoir; and an actuator associated with said spin top and said candy dispensing mechanism, said actuator being movable to a first position and movable to a second position, movement of said actuator to said first position causing said spin top to be launched from said housing so that said spin top may land on a surface and spin on said downwardly extending member, and movement of said actuator to said second position causing one of said pieces of candy to be dispensed through said dispensing opening.

21. A candy dispenser as defined in claim 20 wherein said spin top has an upper portion with an animated figure disposed thereon.

22. A candy dispenser as defined in claim 20 wherein said spin top has a lower portion with at least one latching member associated therewith and wherein said candy dispenser additionally comprises a latch having a flexible arm with an end that makes contact with said latching member to maintain said spin top in a ready state.

23. A candy dispenser as defined in claim 20 additionally comprising a spring associated with said actuator that maintains said actuator in a neutral position between said first and second positions.

24. A candy dispenser as defined in claim 20 wherein said spin top comprises a plastic material having a mass-per-unit-volume and wherein a weight is disposed within said plastic material, said weight having a mass-per-unit-volume greater than that of said plastic material.

* * * * *